US009007154B2

(12) United States Patent
Lehmann et al.

(10) Patent No.: US 9,007,154 B2
(45) Date of Patent: Apr. 14, 2015

(54) HINGED ARMATURE BEARING FOR MAGNETIC TRIPPING DEVICE

(71) Applicants: Stephan Lehmann, Hahnbach (DE); Michael Poles, Radevormwald (DE)

(72) Inventors: Stephan Lehmann, Hahnbach (DE); Michael Poles, Radevormwald (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/749,034

(22) Filed: Jan. 24, 2013

(65) Prior Publication Data

US 2013/0207755 A1 Aug. 15, 2013

(30) Foreign Application Priority Data

Feb. 13, 2012 (DE) ..... 10 2012 202 084

(51) Int. Cl.
*H01H 77/00* (2006.01)
*H01H 36/00* (2006.01)
*H01H 71/24* (2006.01)

(52) U.S. Cl.
CPC ..... *H01H 36/00* (2013.01); *H01H 71/2472* (2013.01)

(58) Field of Classification Search
USPC ..... 335/16, 21, 78
See application file for complete search history.

(56) References Cited

U.S. PATENT DOCUMENTS 2,447,652 A * 8/1948 Jennings ..... 335/37
2,621,269 A * 12/1952 Julliard ..... 335/187
2,882,368 A * 4/1959 Sauer ..... 335/203
3,800,250 A * 3/1974 Mori et al. ..... 335/128
3,849,748 A * 11/1974 Orriss ..... 335/174
4,045,755 A 8/1977 Schroeder et al.
4,048,600 A * 9/1977 Dietrich ..... 335/128
4,112,400 A * 9/1978 Jaidinger et al. ..... 335/128
4,124,832 A * 11/1978 Aigner ..... 335/128
4,199,740 A * 4/1980 Woods ..... 335/202
4,267,540 A * 5/1981 Iketani ..... 335/128
4,378,546 A 3/1983 Altemir
4,616,199 A * 10/1986 Oster ..... 335/35

(Continued)

FOREIGN PATENT DOCUMENTS

DE 0893095 B 10/1953
DE 893095 B 10/1953

(Continued)

OTHER PUBLICATIONS

Priority document for German Publication No. 10 2012 202 084.5.

(Continued)

*Primary Examiner* — Shawki S Ismail
*Assistant Examiner* — Lisa Homza
(74) *Attorney, Agent, or Firm* — Harness, Dickey & Pierce, P.L.C.

(57) ABSTRACT

A hinged armature arrangement, for a magnetic tripping device of an electrical switching device, includes a yoke, a hinged armature and a hinged armature spring for embodying a spring force on the hinged armature. The hinged armature is mounted at a first end in a hinged armature bearing. The hinged armature bearing includes a contact surface and a stop surface. The hinged armature spring is arranged on the hinged armature such that at least one first part of the spring force acts against a magnetic force, which is exerted on the hinged armature when a current path is energized. In a particular embodiment, the contact surface and the stop surface are arranged at an angle α of less than 90° relative to one another.

18 Claims, 3 Drawing Sheets

(56) References Cited

U.S. PATENT DOCUMENTS

| | | | | | |
|---|---|---|---|---|---|
| 4,616,200 | A | * | 10/1986 | Fixemer et al. | 335/35 |
| 4,618,842 | A | * | 10/1986 | Nestlen et al. | 335/128 |
| 4,682,133 | A | * | 7/1987 | Kern | 335/119 |
| 4,695,813 | A | * | 9/1987 | Nobutoki et al. | 335/78 |
| 4,701,734 | A | * | 10/1987 | Nakano et al. | 335/128 |
| 4,803,589 | A | * | 2/1989 | Kimpel | 361/210 |
| 4,818,965 | A | * | 4/1989 | Hinrichs et al. | 335/274 |
| 4,956,623 | A | * | 9/1990 | Kimpel Rolf-Dieter | 335/128 |
| 4,972,166 | A | * | 11/1990 | Mitsch et al. | 335/128 |
| 5,063,366 | A | * | 11/1991 | Edelhaeuser et al. | 335/271 |
| 5,065,127 | A | * | 11/1991 | Mitschik et al. | 335/270 |
| 5,191,306 | A | * | 3/1993 | Kaji et al. | 335/78 |
| 5,202,663 | A | * | 4/1993 | Tomono et al. | 335/86 |
| 5,239,281 | A | * | 8/1993 | Tomono et al. | 335/78 |
| 5,396,204 | A | * | 3/1995 | Matsuoka et al. | 335/78 |
| 5,894,254 | A | * | 4/1999 | Reiter et al. | 335/80 |
| 6,043,730 | A | * | 3/2000 | Maenishi et al. | 335/229 |
| 6,794,963 | B2 | * | 9/2004 | O'Keeffe et al. | 335/21 |
| 7,023,306 | B2 | * | 4/2006 | Nishida et al. | 335/132 |
| 7,106,154 | B2 | * | 9/2006 | Takano et al. | 335/129 |
| 7,157,995 | B2 | * | 1/2007 | Nishida et al. | 335/126 |
| 7,646,273 | B2 | * | 1/2010 | Kobayashi | 335/275 |
| 7,999,641 | B2 | * | 8/2011 | Broghammer et al. | 335/35 |
| 8,179,217 | B2 | * | 5/2012 | Kawaguchi et al. | 335/80 |
| 2002/0135446 | A1 | * | 9/2002 | Takano et al. | 335/128 |
| 2003/0020574 | A1 | * | 1/2003 | Sato et al. | 335/128 |
| 2004/0036561 | A1 | * | 2/2004 | Reiter | 335/80 |
| 2004/0150496 | A1 | * | 8/2004 | Lias et al. | 335/2 |
| 2004/0150497 | A1 | * | 8/2004 | Lias et al. | 335/21 |
| 2005/0040920 | A1 | * | 2/2005 | Takano et al. | 335/128 |
| 2005/0151606 | A1 | * | 7/2005 | Nishida et al. | 335/128 |
| 2006/0091985 | A1 | * | 5/2006 | Mochizuki et al. | 335/128 |
| 2008/0001689 | A1 | * | 1/2008 | Tsutsui et al. | 335/187 |

FOREIGN PATENT DOCUMENTS

| | | | |
|---|---|---|---|
| DE | 2558065 | A1 | 6/1977 |
| DE | 2558065 | A1 | 6/1977 |
| DE | 3640326 | A1 | 6/1988 |
| DE | 3640326 | A1 | 6/1988 |
| DE | 3880055 | T2 | 10/1993 |
| DE | 3880055 | T2 | 10/1993 |
| EP | 0166266 | A2 | 1/1986 |
| EP | 0166266 | A2 | 1/1986 |

OTHER PUBLICATIONS

German Search Report dated Sep. 13, 2012.

Office Action for Mexican patent application No. MX/a/2013/001746 dated Mar. 20, 2014.

* cited by examiner

HINGED ARMATURE BEARING FOR MAGNETIC TRIPPING DEVICE

PRIORITY STATEMENT

The present application hereby claims priority under 35 U.S.C. §119 to German patent application number DE 10 2012 202 084.5 filed Feb. 13, 2012, the entire contents of which are hereby incorporated herein by reference.

FIELD

At least one embodiment of the present invention generally relates to a hinged armature arrangement for a magnetic tripping device of an electrical switching device, to a magnetic tripping device of an electrical switching device and/or to an electrical switching device.

BACKGROUND

Magnetic tripping devices for electrical switching devices are essentially known. In a classical embodiment of a magnetic tripping device, this includes, in particular, three parts, namely a yoke, a hinged armature and a hinged armature spring. The hinged armature is pre-tensioned by the hinged armature spring. A current, which flows through a conductor or current path guided in the yoke, induces a magnetic field in the yoke and in the hinged armature.

The magnetic field exerts a force on the hinged armature in the air gap between the hinged armature and the yoke, which counteracts in particular at least part of the spring force. Once the current and thus the magnetic field induced thereby in the yoke exceeds a specific strength, the force of the magnetic field on the hinged armature also exceeds the spring force, thereby drawing the hinged armature toward the yoke. This may be caused in particular by a current peak, such as occurs in the event of a short-circuit. The yoke and the hinged armature thus form a magnetic circuit.

In the process, the hinged armature interrupts the power circuit, especially for example by way of a downstream mechanism. In order to be able to execute the afore-described movement, the hinged armature is mounted in a hinged armature bearing. In such cases the bearing has an influence on the precision with which the current can be set when the magnetic tripping devices trip. A bearing in which the hinged armature firstly executes a linear sliding movement and in particular not immediately a pivoting movement when the magnetic field in the hinged armature bearing is increasing, results in a reduction in the precision of the tripping current.

DE 38 80 055 T2 discloses a magnetic tripping device. With this magnetic tripping device, a retaining element is also provided on the hinged armature, which is hinged on a plate attached as an additional element on the yoke. As a result, a defined contact surface and therewith a defined support of the hinged armature can be achieved. The embodiment with additional components nevertheless renders these magnetic tripping devices costly and complicated in terms of assembly.

SUMMARY

At least one embodiment of the present invention at least partly eliminates at least one of the afore-described disadvantages of known hinged armature arrangements. In particular, at least one embodiment of the present invention provides a hinged armature arrangement for a magnetic tripping device of an electrical switching device, a magnetic tripping device and an electrical switching device, which comprise a defined hinged armature bearing and thus a possibility of precisely setting the tripping current in a cost-effective and simple manner.

Further features and details of the invention result from the subclaims, the description and the drawings. Here features and details which are described in conjunction with the inventive hinged armature arrangement naturally also apply in conjunction with the inventive magnetic tripping device and the inventive electrical switching device and in each instance vice versa, so that with respect to the disclosure there is or can always always be reciprocal reference to the individual invention aspects.

According to a first aspect of at least one embodiment the invention, a hinged armature arrangement is disclosed for a magnetic tripping device of an electrical switching device, comprising a yoke, a hinged armature and a hinged armature spring for embodying a spring force on the hinged armature, wherein the hinged armature is supported at a first end in a hinged armature bearing, wherein the hinged armature bearing comprises a contact surface and a stop surface, wherein the hinged armature spring is arranged on the hinged armature such that at least a first part of the spring force acts against a magnetic force, which is exerted on the hinged armature when a current path is energized. In particular, the hinged armature arrangement is embodied for a magnetic tripping device such that the contact surface and the stop surface are arranged at an angle $\alpha$ of less than 90° relative to one another.

BRIEF DESCRIPTION OF THE DRAWINGS

The present invention is explained in more detail below with the aid of the appended drawings, in which shown schematically are.

Elements with the same function and mode of operation are provided with the same reference characters in FIGS. 1 to 4.

DETAILED DESCRIPTION OF THE EXAMPLE EMBODIMENTS

Figure 1:
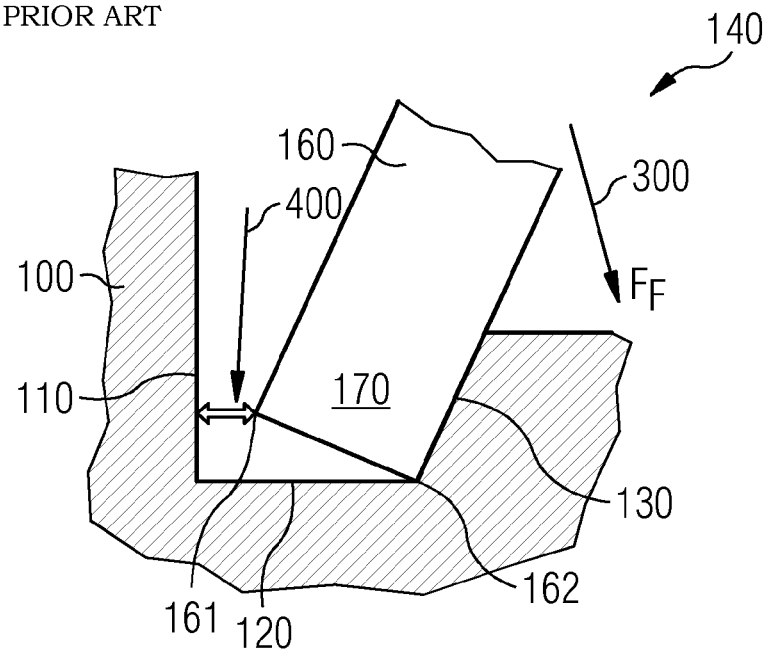
FIG 1 PRIOR ART
FIG. 1 a hinged armature bearing according to the prior art.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first aspect of at least one embodiment the invention, a hinged armature arrangement is disclosed for a magnetic tripping device of an electrical switching device, comprising a yoke, a hinged armature and a hinged armature spring for embodying a spring force on the hinged armature, wherein the hinged armature is supported at a first end in a hinged armature bearing, wherein the hinged armature bearing comprises a contact surface and a stop surface, wherein the hinged armature spring is arranged on the hinged armature such that at least a first part of the spring force acts against a magnetic force, which is exerted on the hinged armature when a current path is energized. In particular, the hinged armature arrangement is embodied for a magnetic tripping device such that the contact surface and the stop surface are arranged at an angle $\alpha$ of less than 90° relative to one another.

The hinged armature is mounted in the hinged armature bearing. In particular, its first end is inserted into the hinged armature bearing such that it rests with its contact edge against the contact surface. When the current path and thus the yoke are energized with a current which is greater than the tripping current, the hinged armature should in particular rotate about a pivot edge which is arranged on the contact surface of the hinged armature bearing. With an arrangement of the contact surface and the stop surface at an angle of 90° relative to one another, the hinged armature can rest with its contact edge on the contact surface without resting with its pivot edge on the contact surface.

A spacing may exist between its pivot edge and the stop surface. When the current path or the yoke is energized with a current which is greater than the tripping current, the hinged armature in such a case firstly executes a sliding movement in the direction of the stop surface, until the pivot edge rests on the stop surface. The hinged armature firstly then pivots about the pivot edge and separates the power circuit, in particular on account of a mechanism arranged downstream thereof. The afore-described sliding prevents a precise and accurate setting of the tripping current.

The arrangement of the contact surface and the stop surface at an angle $\alpha$ of less than 90° prevents this slipping. The contact edge of the first end is already arranged on the contact surface and at the same time the pivot edge is already arranged on the stop surface of the hinged armature bearing upon assembly of the hinged armature in the hinged armature bearing. When the current path or the yoke is energized with a current which is greater than the tripping current, the hinged armature consequently immediately executes the provided pivot movement.

In particular, a sliding of the hinged armature prior to the actual tripping is already prevented by the shape of the hinged armature bearing, which is determined by the arrangement of the contact surface and the stop surface at an angle $\alpha$ of less than 90° relative to one another. This provides for a defined tripping of the hinged armature arrangement, both in respect of the timing of the tripping and also of the necessary tripping current. The hinged armature arrangement can be adjusted very precisely by combining the dimensioning of the hinged armature spring and/or the energization of the current path or yoke.

Furthermore, provision can be made with at least one embodiment of the inventive hinged armature arrangement for at least one second part of the spring force to act on the hinged armature in the direction of the hinged armature bearing. The at least one second part of the spring force therefore pushes the hinged armature into the hinged armature bearing. A defined fit of the hinged armature in the hinged armature bearing is thus produced. This simultaneously additionally assists and safeguards the contact between the contact edge of the first end of the hinged armature and the contact surface of the hinged armature support and the pivot edge of the first end of the hinged armature and the stop surface of the hinged armature bearing.

Furthermore, with at least one embodiment of an inventive hinged armature arrangement, provision can be made for the spring force of the hinged armature spring to engage at a second end of the hinged armature facing the first end. Particularly for the at least one second part of the spring force, this engagement at the second end of the hinged armature represents a significant leverage, as a result of which the spring force can be used in as optimum a manner as possible. The hinged armature is mounted via its first end in the hinged armature bearing. As a result, its second end facing the first end moves furthest with a pivot movement which is tripped when the current path or the yoke is energized with a current which is greater than the tripping current and the magnetic field generated thereby.

Application of the spring force of the hinged armature spring at the second end of the hinged armature also represents a good position as counter force for this movement. The large movement of the second end enables the spring force to be set particularly precisely in respect of the magnetic force to be compensated.

Furthermore, with at least one embodiment of an inventive hinged armature arrangement, provision can be made for the contact surface to be flat or curved. In particular, it is important here for the flat or curved contact surface to form an angle of less than 90° relative to the stop surface. A flat or curved embodiment of the contact surface makes it possible to adjust the hinged armature bearing to the widest variety of requirements. The assembly of the hinged armature in the hinged armature bearing can also be assisted by the shape, in particular by a flat or curved embodiment of the contact surface. A particularly simple assembly of the hinged armature arrangement can be enabled as a result.

Furthermore, provision can be made with at least one embodiment of an inventive hinged armature arrangement for the hinged armature bearing to be embodied as a knife edge bearing. A knife edge bearing represents a mechanically very simple bearing. No shafts and no additional parts are required for this bearing. In particular, a knife edge bearing is very cost-effective to manufacture and simple in terms of assembly.

Provision can be made particularly preferably with at least one embodiment of an inventive hinged armature arrangement for the contact surface and the stop surface of the hinged armature bearing to be parts of the yoke. In particular, provision can be made for the contact surface and the stop surface of the hinged armature bearing to be embodied in one piece, preferably monolithically, with the yoke. As a result, no additional assembly is required in order to connect the hinged armature bearing to the yoke. As a result, costs can be saved in particular with the assembly and a minimal assembly time achieved.

Furthermore, provision can preferably be made with at least one embodiment of an inventive hinged armature arrangement for the contact surface and the stop surface to be arranged at an angle $\alpha$ of less than 75° relative to one another. With an angle between the contact surface and the stop surface between 75° and 90°, a self-locking takes place. With a self-locking, a resistance to a rotation of two elements placed adjacent to one another is produced by means of friction. This self-locking can be prevented by way of an arrangement of the contact surface and the stop surface at an angle $\alpha$ of less than 75° relative to one another. With an arrangement of the contact surface and the stop surface of this type relative to one another, no or at least no significant hindrance in terms of the pivot movement of the hinged armature in the hinged armature bearing occurs on account of the self-locking.

Provision can preferably also be made in at least one embodiment of an inventive hinged armature arrangement for the transition region between the contact surface and the stop surface to be rounded. As a result, manufacture of the hinged armature bearing is facilitated. Particularly when using a stamping process to generate the contact surface and the stop surface, the manufacturing process can be facilitated and thus configured in a more cost-effective manner.

Furthermore, provision can be made with at least one embodiment of an inventive hinged armature arrangement for a counter surface to be provided, which is embodied to support the hinged armature against at least one part of the spring force of the hinged armature spring. The counter surface may for instance be used as a supporting surface for the hinged armature prior to assembly of the hinged armature arrangement in a magnet tripping device of an electrical switching device. Assembly of the hinged armature arrangement can be facilitated as a result. During operation, the spacing between the counter surface and the hinged armature should however be as great as possible.

According to a second aspect of at least one embodiment of the invention, a magnetic tripping device of an electrical switching device is disclosed comprising a hinged armature arrangement and a current path, which is arranged in order to embody a magnetic field on and/or in the yoke of the hinged armature arrangement. In particular, at least one embodiment of the inventive magnetic tripping device of an electrical switching device is embodied such that the hinged armature arrangement is embodied in accordance with at least one embodiment of the first aspect of the invention. All advantages, which are described in conjunction with embodiments of an inventive hinged armature arrangement, therefore naturally also apply to embodiments of an inventive magnetic tripping device of an electrical switching device, which comprises a hinged armature arrangement of this type.

Furthermore, provision can be made with at least one embodiment of an inventive magnetic tripping device for the current path or an electric conductor to be embodied as busbars, coils or as bimetallic strips. Particularly high currents can flow across a busbar without incurring damage to the current path or the conductor. In particular, the embodiment of the current path as a bimetallic strip enables further development of the magnetic tripping device in respect of a thermomagnetic tripping device. The capabilities of an inventive magnetic tripping device are as a result increased still further.

According to a third aspect of at least one embodiment of the invention, an electrical switching device is disclosed comprising at least one magnetic tripping device. In particular, the at least one magnetic tripping device of the electrical switching device is embodied here according to at least one embodiment of the second aspect of the invention. The at least one magnetic tripping device thus comprises a hinged armature arrangement according to at least one embodiment of the first aspect of the invention. All advantages, which have been described in conjunction with a hinged armature arrangement according to the first aspect of the invention or a magnetic tripping device according to the second aspect of the invention naturally therefore also apply to embodiments of an electrical switching device, which comprises a magnetic tripping device of this type having a hinged armature arrangement of this type.

Furthermore, provision can be made with an electrical switching device for this to be a circuit breaker, in particular a compact circuit breaker. Circuit breakers are in particular electromagnetic self-acting switches. They may be used in particular as automatic cutouts to safeguard power circuits against short-circuit and/or overload. A use as a motor overload switch is widespread. The embodiment of the electrical switching device as a circuit breaker, in particular as a compact circuit breaker, enables the electrical switching device to be used in a large spectrum of electrical applications.

Figure 2:
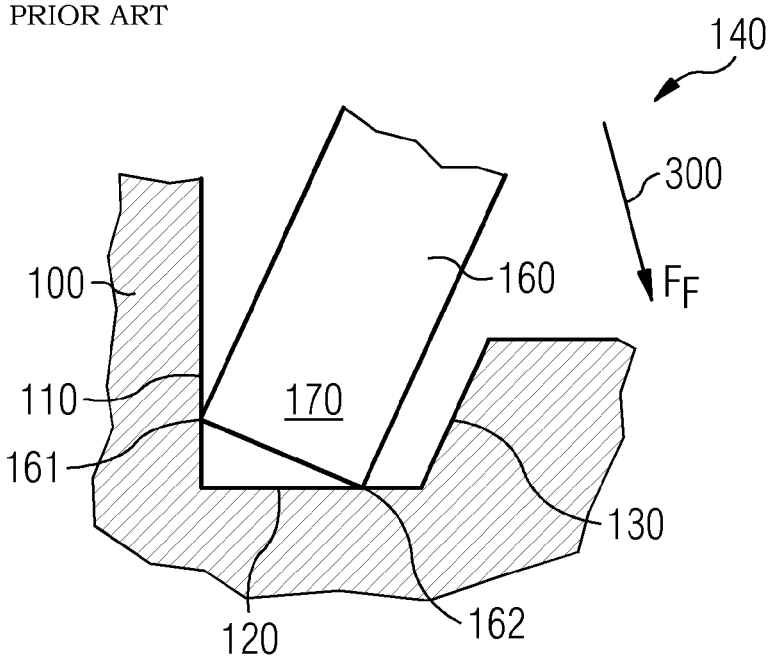
FIG 2 PRIOR ART
FIG. 2 the hinged armature bearing according to the prior art with an off-center hinged armature, FIG. 3 an inventive hinged armature bearing and FIG. 4 an inventive magnetic tripping device.

FIG. 1 and FIG. 2 show a hinged armature bearing 140, as is known according to the prior art. The stop surface 110, the contact surface 120 and the counter surface 130 are embodied as part of the yoke 100. In particular, the stop surface 110 and the contact surface 120 are arranged at an angle of 90° relative to one another. The first end 170 of the hinged armature 160 is inserted into the hinged armature bearing 140. The spring force 300 engages at the second end 180 (not shown) of the hinged armature 160. The hinged armature 160 is pushed into the hinged armature bearing 140 by way of at least one part of the spring force 300. The hinged armature 160 rests on one side on the counter surface 130 of the hinged armature bearing 140, wherein the contact edge 162 is arranged on the contact surface 120. The pivot edge 161 is however not arranged on the stop surface 110. The spring force 300 can also not bring about any movement of the hinged armature 160 such that the pivot edge 161 would rest on the stop surface 110.

A spacing 400 exists between the pivot edge 161 and the stop surface 110. In particular, on account of the arrangement of the stop surface 110 and the contact surface 120 at an angle of 90° relative to one another, a movement of the pivot edge 161 in the direction of the stop surface 110 is prevented. Only when a current path or the yoke 100 is energized with a current greater than the tripping current will the hinged armature 160 be drawn in the direction of the stop surface and executes a sliding movement. This is shown in FIG. 2. Nevertheless, a defined adjustment of the tripping current is prevented via this sliding movement. As a result of the hinged armature 160 firstly executing a sliding movement and then a pivot movement about the pivot edge 161, large uncertainties result in the tripping current, which have to be taken into account by security tolerances in the specifications of the tripping current.

Figure 3:
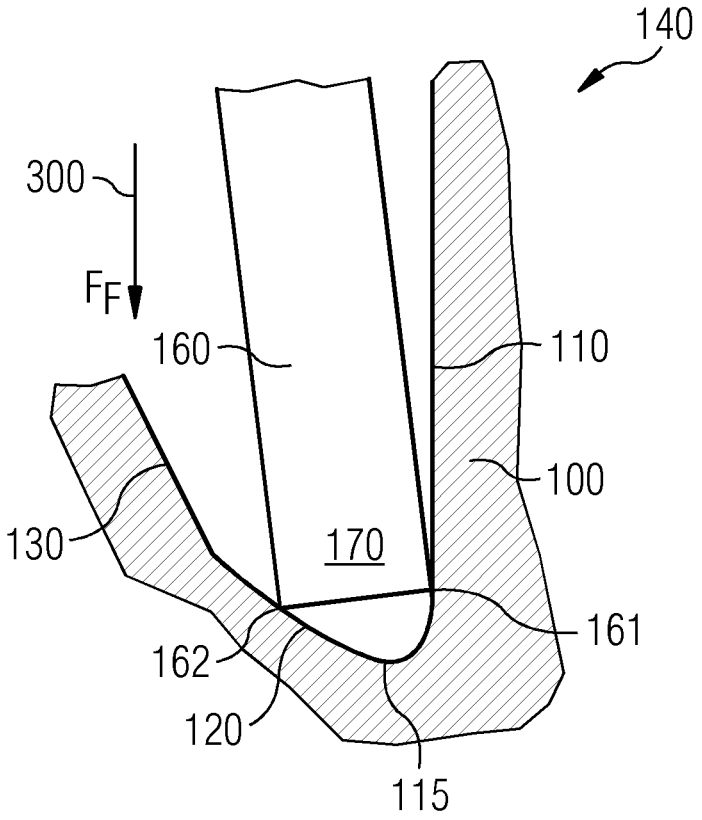

FIG. 3 shows an embodiment of an inventive hinged armature bearing 140. In particular, the stop surface 110 and the contact surface 120 are arranged such that they are arranged at an angle $\alpha$ of less than 90° relative to one another. As a result, the spring force 300, which engages at the second end 180 (not shown) of the hinged armature 160, already causes the hinged armature 160 to be pushed into the hinged armature bearing 140 such that the contact edge 162 rests on the contact surface 120 and at the same time the pivot edge 161 rests on the stop surface 110. The counter surface 130 is no longer touched by the hinged armature 160. It may therefore be embodied to be particularly small and is only used for assembly of the hinged armature 160 in the hinged armature bearing 140 or the entire hinged armature arrangement 10 in the magnetic tripping device 1 (not shown).

The stop surface 110 and the contact surface 120 are arranged in particular at an angle $\alpha$ of less than 75° relative to one another in order to prevent a self-locking of the pivot movement of the hinged armature 160. The transition region 115 between the contact surface 120 and the stop surface 110 is rounded, as a result of which in particular the manufacture of the two surfaces 110, 120, which are embodied in one piece and monolithically with the yoke 100, is simplified. When the current path 200 (not shown) is energized with a current which is greater than the tripping current, the hinged armature 160 can tilt immediately about the pivot edge 161 and execute a defined pivot movement. A precise adjustment of the tripping current, which is required for this pivot movement, is therefore possible.

Figure 4:
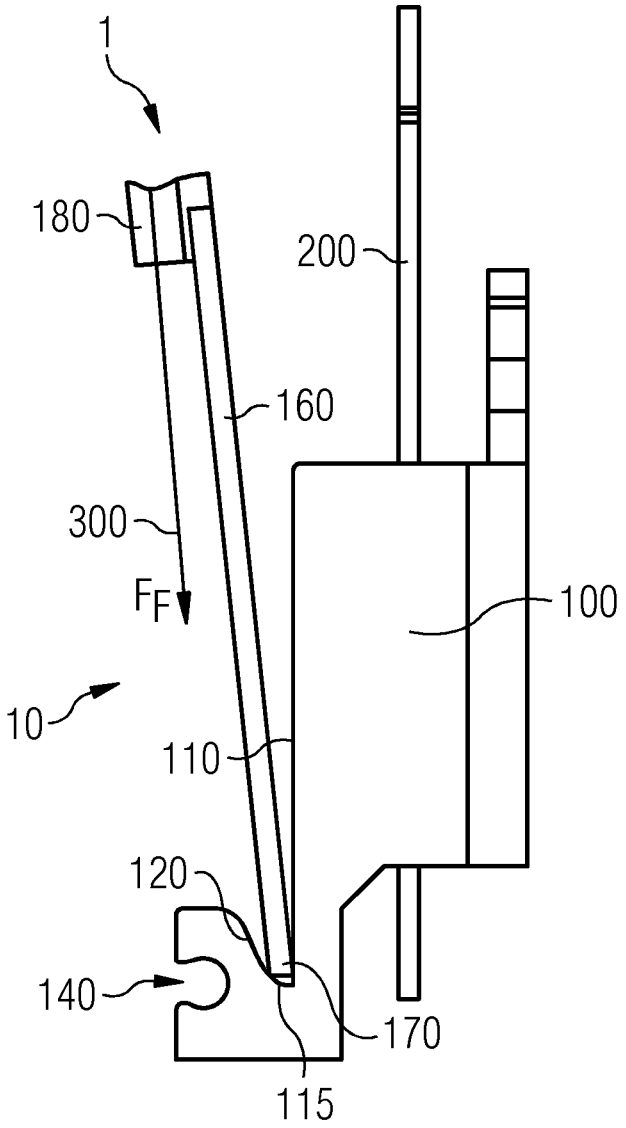

FIG. 4 shows an embodiment of an inventive magnetic tripping device 1, which has an embodiment of an inventive hinged armature arrangement 10. A current path 200 is guided in the yoke 100. A magnetic field is induced in the yoke 100 through this current path or this electrical conductor 200, which exerts a force on the hinged armature 160. This force counteracts the spring force 300. The spring force 300 applies here at the second end 180 of the hinged armature 160. The spring force 300 applies here at the second end 180 of the hinged armature 160.

At least one part of the spring force 300 means that the hinged armature 160, in particular the first end 170 of the hinged armature 160, is pushed into the hinged armature bearing 140. The hinged armature bearing 140 here comprises in particular a contact surface 120 and a stop surface 110, which are arranged at an angle $\alpha$ of less than 90° relative to one another. In particular, the two surfaces 110, 120 are arranged at an angle of less than 75° relative to one another in order to avoid hindering the pivot movement of the hinged armature 160 via self-locking. The transition region 115 between the stop surface 110 and the contact surface 120 is also embodied to be rounded. As a result, the manufacture of the hinged armature bearing 140, which is embodied in particular in one piece and monolithically with the yoke 100, is simplified.

A magnetic field is induced in the yoke 100 when the current path 200 is energized. If a current which is greater than the tripping current flows through the current path 200, the force exerted by the magnetic field on the hinged armature 160 is greater than part of the spring force 300, which counteracts the magnetic force. The hinged armature 160 executes a defined pivot movement in the hinged armature bearing 140 and then rests with its longitudinal side on the stop surface 110. The power circuit, in which the current path 200 is arranged, is interrupted by a mechanism (not shown) arranged downstream thereof. The tripping current is dimensioned here such that it occurs in particular with a short-circuit. As a result, an inventive magnetic tripping device 1 can be used in particular in circuit breakers.

The afore-cited explanation of the embodiments only describes the present invention within the scope of examples. Naturally individual features of the embodiments, provided they are technically meaningful, can be freely combined with one another, without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Magnetic tripping device
10 Hinged armature arrangement
100 Yoke
110 Stop surface
115 Transition region
120 Contact surface
130 Counter surface
140 Hinged armature bearing
160 Hinged armature
161 Pivot edge
162 Contact edge
170 First end
180 Second end
200 Current path/electrical conductor
300 Spring force
400 Spacing

What is claimed is:

1. A hinged armature arrangement for a magnetic tripping device of an electrical switching device, comprising:

a yoke;

a hinged armature bearing, the hinged armature bearing including a contact surface and a stop surface arranged at an angle of less than 75° relative to one another;

a hinged armature mounted at a first end in the hinged armature bearing; and a hinged armature spring configured to embody a spring force on the hinged armature, the hinged armature spring being arranged on the hinged armature such that at least a first part of the spring force acts against a magnetic force exerted on the hinged armature when a current path is energized.

2. The hinged armature arrangement of claim 1, wherein at least one second part of the spring force acts on the hinged armature in a direction of the hinged armature bearing.

3. The hinged armature arrangement of claim 1, wherein the spring force of the hinged armature spring engages at a second end of the hinged armature facing the first end.

4. The hinged armature arrangement of claim 1, wherein the contact surface is embodied to be flat or curved.

5. The hinged armature arrangement of claim 1, wherein the hinged armature bearing is embodied as a knife edge bearing.

6. The hinged armature arrangement of claim 1, wherein the contact surface and the stop surface of the hinged armature bearing are parts of the yoke.

7. The hinged armature arrangement of claim 1, wherein a transition region between the contact surface and the stop surface is rounded.

8. The hinged armature arrangement of claim 1, wherein a counter surface is provided, embodied to support the hinged armature against at least one part of the spring force of the hinged armature spring.

9. A magnetic tripping device of an electrical switching device, comprising:

the hinged armature arrangement of claim 1; and a current path, arranged in a yoke of the hinged armature arrangement to embody a magnetic field.

10. The magnetic tripping device of claim 9, wherein the current path is embodied as a busbar, coil or as a bimetallic strip.

11. An electrical switching device, comprising:

at least one magnetic tripping device of claim 10.

12. An electrical switching device, comprising:

at least one magnetic tripping device of claim 9.

13. The electrical switching device of claim 12, wherein the electrical switching device is a circuit breaker.

14. The electrical switching device of claim 13, wherein the circuit breaker is a compact circuit breaker.

15. The hinged armature arrangement of claim 1, the hinged armature having a contact edge at a first corner of the hinged armature and a pivot edge at a second corner of the hinged armature.

16. The hinged armature arrangement of claim 15, wherein the contact edge of the hinged armature rests on the contact surface and the pivot edge rests on the stop surface.

17. The hinged armature arrangement of claim 1, wherein the hinged armature bearing further includes a flat contact surface and a flat stop surface arranged at an angle of less than 75° relative to one another and the contact surface and the stop surface adjoin at an apex of the angle.

18. The hinged armature arrangement of claim 1, wherein the hinged armature bearing further includes a flat counter surface extending from an end of the contact surface at an obtuse angle.

* * * * *